US008055453B2

(12) United States Patent
Wyatt

(10) Patent No.: US 8,055,453 B2
(45) Date of Patent: Nov. 8, 2011

(54) SENSING AND ESTIMATING IN-LEAKAGE AIR IN A SUBAMBIENT COOLING SYSTEM

(75) Inventor: William G. Wyatt, Plano, TX (US)

(73) Assignee: Raytheon Company, Waltham, MA (US)

( * ) Notice: Subject to any disclaimer, the term of this patent is extended or adjusted under 35 U.S.C. 154(b) by 448 days.

(21) Appl. No.: 12/233,905

(22) Filed: Sep. 19, 2008

(65) Prior Publication Data

US 2010/0076695 A1 Mar. 25, 2010

(51) Int. Cl.
*F25B 43/04* (2006.01)
*F25B 43/00* (2006.01)

(52) U.S. Cl. ..... 702/24; 702/23; 702/55; 702/182; 62/85; 62/195

(58) Field of Classification Search ..... 702/24
See application file for complete search history.

(56) References Cited

U.S. PATENT DOCUMENTS

| | | | | |
|---|---|---|---|---|
| 2,986,894 | A * | 6/1961 | Endress et al. | 62/85 |
| 4,484,453 | A | 11/1984 | Niess | |
| 4,531,375 | A | 7/1985 | Zinsmeyer | |
| 4,984,431 | A * | 1/1991 | Mount et al. | 62/85 |
| 5,337,578 | A * | 8/1994 | Ptacek et al. | 62/195 |
| 5,355,685 | A * | 10/1994 | Stie et al. | 62/85 |
| 5,400,613 | A * | 3/1995 | O'Neal | 62/195 |
| 5,752,411 | A * | 5/1998 | Harpster | 73/861.04 |
| 6,526,755 | B1 * | 3/2003 | Harpster | 60/690 |
| 6,957,550 | B2 | 10/2005 | Wyatt et al. | 62/475 |
| 7,533,536 | B1 * | 5/2009 | Zugibe et al. | 62/127 |
| 2002/0173929 | A1 * | 11/2002 | Seigel | 702/130 |
| 2003/0159458 | A1 * | 8/2003 | Fang et al. | 62/305 |
| 2005/0109032 | A1 * | 5/2005 | Harpster | 60/685 |
| 2006/0042276 | A1 * | 3/2006 | Doll et al. | 62/129 |
| 2008/0027568 | A1 * | 1/2008 | Pearson | 700/80 |

FOREIGN PATENT DOCUMENTS

| | | |
|---|---|---|
| DE | 35 17 220 | 11/1985 |
| GB | 2 276 229 | 9/1994 |
| JP | 54 054355 A | 4/1979 |
| JP | 01 088074 A | 4/1989 |
| JP | 03 001058 A | 1/1991 |

OTHER PUBLICATIONS

PCT, Notification of Transmittal of the International Search Report and the Written Opinion of the International Searching Authority, or the Declaration, International Application No. PCT/US2009/056437 filed Sep. 10, 2009 (13 pages), Mar. 10, 2010.

Richard M. Weber, U.S. Appl. No. 12/249,344, filed Oct. 20, 2008, entitled *Removing Non-Condensable Gas from a Subambient Cooling System*.

* cited by examiner

*Primary Examiner* — Sujoy Kundu
*Assistant Examiner* — Michael Dalbo
(74) *Attorney, Agent, or Firm* — Baker Botts L.L.P.

(57) ABSTRACT

In certain embodiments, estimating air in a cooling system includes measuring a property that can be used to estimate the air to yield a plurality of measurements. The measurements are performed for different heat loads and for different concentrations of non-condensable gas in the cooling system. The measurements are stored a data set.

21 Claims, 1 Drawing Sheet

SENSING AND ESTIMATING IN-LEAKAGE AIR IN A SUBAMBIENT COOLING SYSTEM

TECHNICAL FIELD OF THE DISCLOSURE

This disclosure relates generally to the field of cooling systems and, more particularly, to sensing and estimating non-condensable gas in a subambient cooling system.

BACKGROUND

A variety of different types of structures can generate heat or thermal energy in operation. To prevent such structures from over-heating, a variety of different types of cooling systems may be utilized to dissipate the thermal energy, including subambient cooling systems.

SUMMARY OF THE DISCLOSURE

In accordance with the present invention, disadvantages and problems associated with previous techniques for keyword searching may be reduced or eliminated.

In certain embodiments, estimating air in a cooling system includes measuring a property that can be used to estimate the air to yield a plurality of measurements. The measurements are performed for different heat loads and for different concentrations of non-condensable gas in the cooling system. The measurements are stored a data set.

In certain embodiments, measurements may be taken of a liquid level of a condenser, a temperature differential between an evaporator and the condenser, a pressure differential between the evaporator and the condenser, a temperature gradient of the condenser, and/or a pressure gradient of the condenser. In certain embodiments, measurements may be taken at an inlet of the condenser and an outlet of the evaporator. In certain embodiments, measurements may be taken inside of the condenser and in between the condenser and the evaporator.

Certain embodiments of the disclosure may provide numerous technical advantages. For example, a technical advantage of one embodiment may include the capability to sense and estimate in-leakage air in a subambient cooling system. Other technical advantages of other embodiments may include the capability to determine when in-leakage air should be removed from a subambient cooling system. Additional technical advantages of other embodiments may include the capability to allow cooling systems to operate for longer periods with improved efficiency. Other technical advantages of other embodiments may include the capability to selectively remove air from a section or sections of a subambient cooling system. Still yet other technical advantages of other embodiments may include improved capability to monitor and control a cooling system.

Although specific advantages have been enumerated above, various embodiments may include all, some, or none of the enumerated advantages. Additionally, other technical advantages may become readily apparent to one of ordinary skill in the art after review of the following figures and description.

BRIEF DESCRIPTION OF THE DRAWINGS

For a more complete understanding of example embodiments of the present invention and its advantages, reference is now made to the following description, taken in conjunction with the accompanying drawings, in which.

DETAILED DESCRIPTION

It should be understood at the outset that although example embodiments of the present disclosure are illustrated below, the present disclosure may be implemented using any number of techniques, whether currently known or in existence. The present disclosure should in no way be limited to the example embodiments, drawings, and techniques illustrated below, including the embodiments and implementation illustrated and described herein. Additionally, the drawings are not necessarily drawn to scale.

A subambient cooling systems (SACS) generally includes a closed loop of fluid with an evaporator, a condenser, and a pump. The evaporator boils the liquid and feeds the liquid/vapor mixture to the condenser. The condenser removes heat (thermal energy) while condensing the vapor, and feeds the condensed liquid to the pump. The pump then returns the liquid to the evaporator to complete the loop. The evaporator absorbs heat (thermal energy) from a source such as hot electronics and the condenser transfers heat (thermal energy) to a cooling source such as the ambient air.

A SACS may be designed to transfer heat by forced, two-phase boiling from a higher temperature heat source to a lower temperature heat sink. In many cases, ambient air is a desirable heat sink. Difficulties with a cooling system, such as a SACS, can arise when the available heat sink (e.g., the ambient air) has a temperature higher than the desired temperature of the heat source (e.g., hot electronics). Accordingly, teachings of some embodiments of the disclosure recognize a cooling system that compensates for circumstances when the heat sink (e.g., ambient air) reaches an undesirable temperature. Additionally, teachings of some embodiments of the disclosure recognize a cooling system that provides a second condenser that allows dissipation of thermal energy to a heat sink. Additionally, teachings of some embodiments of the disclosure recognize a cooling system that provides a mechanism, which can compensate for both undesirably hot and undesirably cold conditions.

Figure 1:
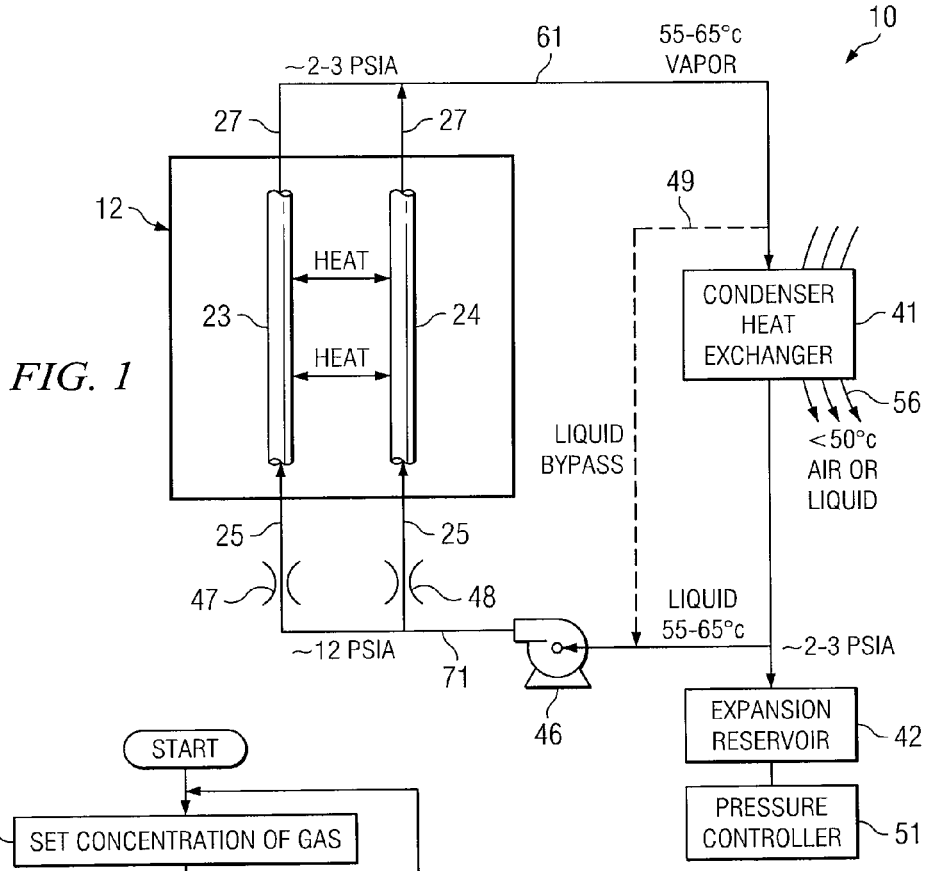
FIG. 1 is a block diagram of an embodiment of a cooling system that may be utilized in conjunction with other embodiments disclosed herein.

FIG. 1 is a block diagram of an embodiment of a cooling system 10 that may be utilized in certain embodiments. Although the details of one cooling system is described below, it should be expressly understood that other cooling systems may be used in conjunction with embodiments of the disclosure.

Cooling system 10 of FIG. 1 is shown cooling a structure 12 that is exposed to or generates thermal energy. Structure 12 may be any of a variety of structures, including, but not limited to, electronic components, circuits, computers, and servers. Because structure 12 can vary greatly, the details of structure 12 are not illustrated and described. Cooling system 10 of FIG. 1 includes a vapor line 61, a liquid line 71, heat exchangers 23 and 24, a pump 46, inlet orifices 47 and 48, a condenser heat exchanger 41, an expansion reservoir 42, and a pressure controller 51.

Structure 12 may be arranged and designed to conduct heat (thermal energy) to heat exchangers 23, 24. To receive this thermal energy, or heat, heat exchanger 23, 24 may be disposed on an edge of structure 12 (e.g., as a thermosyphon, heat pipe, or other device) or may extend through portions of structure 12, for example, through a thermal plane of structure 12. In particular embodiments, heat exchangers 23, 24 may extend up to the components of structure 12, directly receiving thermal energy from the components. Although two heat exchangers 23, 24 are shown in the cooling system 10 of FIG. 1, one heat exchanger or more than two heat exchangers may be used to cool structure 12 in other cooling systems.

In operation, a fluid coolant flows through each of heat exchangers 23, 24. As discussed later, this fluid coolant may be a two-phase fluid coolant, which enters inlet conduits 25 of heat exchangers 23, 24 in liquid form. Absorption of heat from structure 12 causes part or all of the liquid coolant to boil and vaporize such that some or all of the fluid coolant leaves exit conduits 27 of heat exchangers 23, 24 in a vapor phase. To facilitate such absorption or transfer of thermal energy, heat exchangers 23, 24 may be lined with pin fins or other similar devices which, among other things, increase surface contact between the fluid coolant and walls of heat exchangers 23, 24. Additionally, in particular embodiments, the fluid coolant may be forced or sprayed into heat exchangers 23, 24 to ensure fluid contact between the fluid coolant and the walls of heat exchangers 23, 24.

The fluid coolant departs exit conduits 27 and flows through vapor line 61, condenser heat exchanger 41, expansion reservoir 42, pump 46, liquid line 71, and a respective one of two orifices 47 and 48, in order to again to reach inlet conduits 25 of heat exchanger 23, 24. Pump 46 may cause the fluid coolant to circulate around the loop shown in FIG. 1. In particular embodiments, pump 46 may use magnetic drives that do not require seals, which can wear or leak with time. Although vapor line 61 uses the term "vapor" and liquid line 71 uses the terms "liquid", each respective line may have fluid in a different phase. For example, liquid line 71 may contain some vapor, and vapor line 61 may contain some liquid.

Turning now in more detail to the fluid coolant, one highly efficient technique for removing heat from a surface is to boil and vaporize a liquid, a fluid coolant, that is in contact with a surface. As the liquid vaporizes in this process, it inherently absorbs heat to effectuate such vaporization. The amount of heat that can be absorbed per unit volume of a liquid is commonly known as the "latent heat of vaporization" of the liquid. The higher the latent heat of vaporization, the larger the amount of heat that can be absorbed per unit volume of liquid being vaporized.

The fluid coolant used in the embodiment of FIG. 1 may include, but is not limited to, mixtures of antifreeze and water or water alone. In particular embodiments, the antifreeze may be ethylene glycol, propylene glycol, methanol, or other suitable antifreeze. In other embodiments, the mixture may also include fluoroinert. In particular embodiments, the fluid coolant may absorb a substantial amount of heat as it vaporizes, and thus may have a very high latent heat of vaporization.

Water boils at a temperature of approximately 100° C. at an atmospheric pressure of 14.7 pounds per square inch absolute (psia). In particular embodiments, the fluid coolant's boiling temperature may be reduced to between 55-65° C. by subjecting the fluid coolant to a subambient pressure, for example, a pressure between 1-4 psia, such as 2-3 psia.

Turning now in more detail to system 10, orifices 47 and 48 in particular embodiments may facilitate proper partitioning of the fluid coolant among respective heat exchanger 23, 24, and may also help to create a large pressure drop between the output of pump 46 and heat exchanger 23, 24 in which the fluid coolant vaporizes. Orifices 47 and 48 may permit the pressure of the fluid coolant downstream from them to be substantially less than the fluid coolant pressure between pump 46 and orifices 47 and 48, which in this embodiment is shown as approximately 12 psia. Orifices 47 and 48 may have the same size or may have different sizes in order to partition the coolant in a proportional manner that facilitates a desired cooling profile.

In particular embodiments, the fluid coolant flowing from pump 46 to orifices 47 and 48 through liquid line 71 may have a temperature of approximately 55° C. to 65° C. and a pressure of approximately 12 psia as referenced above. After passing through orifices 47 and 48, the fluid coolant may still have a temperature of approximately 55° C. to 65° C., but may also have a lower pressure in the range about 2 psia to 3 psia. Due to this reduced pressure, some or all of the fluid coolant may boil or vaporize as it passes through and absorbs heat from heat exchanger 23 and 24.

After exiting exits ports 27 of heat exchanger 23, 24, the subambient coolant vapor travels through vapor line 61 to condenser heat exchanger 41 where heat, or thermal energy, can be transferred from the subambient fluid coolant to the flow of fluid. The flow of fluid in particular embodiments may have a temperature of less than 50° C. In other embodiments, the flow may have a temperature of less than 40° C. In certain embodiments, as heat is removed from the fluid coolant, any portion of the fluid that is in a vapor phase condenses such that substantially all of the fluid coolant is in liquid form when it exits condenser heat exchanger 41. At this point, the fluid coolant may have a temperature of approximately 55° C. to 65° C. and a subambient pressure of approximately 2 psia to 3 psia. The fluid coolant may then flow to pump 46, which in particular embodiments 46 may increase the pressure of the fluid coolant to a value in the range of approximately 12 psia.

In particular embodiments, a flow of fluid (either gas or liquid) may be forced to flow through condenser heat exchanger 41, for example by a fan or other suitable device. In particular embodiments, the flow may be ambient fluid. Condenser heat exchanger 41 transfers heat from the fluid coolant to the flow of ambient fluid, thereby causing any portion of the fluid coolant which is in the vapor phase to condense back into a liquid phase. In particular embodiments, a liquid bypass 49 may be provided for liquid fluid coolant that either may have exited heat exchangers 23, 24 or that may have condensed from vapor fluid coolant during travel to condenser heat exchanger 41. In particular embodiments, condenser heat exchanger 41 may be a cooling tower.

The liquid fluid coolant exiting the condenser heat exchanger 41 may be supplied to expansion reservoir 42. Since fluids typically take up more volume in their vapor phase than in their liquid phase, expansion reservoir 42 may be provided in order to take up the volume of liquid fluid coolant that is displaced when some or all of the coolant in the system changes from its liquid phase to its vapor phase. An expansion reservoir 42, in conjunction with pressure controller 51, may control the pressure within the cooling loop. The amount of the fluid coolant that is in its vapor phase can vary over time, due in part to the fact that the amount of heat or thermal energy being produced by structure 12 may vary over time, as structure 12 system operates in various operational modes.

The pressure controller 51 may maintain the coolant at a subambient pressure, such as approximately 2-3 psia, along the portion of the loop which extends from orifices 47 and 48 to pump 46, in particular through heat exchangers 23 and 24, condenser heat exchanger 41, and expansion reservoir 42. In particular embodiments, a metal bellows may be used in expansion reservoir 42, connected to the loop using brazed joints. In particular embodiments, pressure controller 51 may control loop pressure by using a motor driven linear actuator that is part of the metal bellows of expansion reservoir 42 or by using small gear pump to evacuate the loop to the desired pressure level. The fluid coolant removed may be stored in the metal bellows whose fluid connects are brazed. In other configurations, pressure controller 51 may utilize other suitable devices capable of controlling pressure. Pressure controller 51 may include a computing device with an interface, logic, a processor, memory, or other suitable components. Although specific pressure and temperature measurements are mentioned in the disclosure, it is explicitly noted that various embodiments may implement and/or operate under pressures and temperatures greater to or less than those specifically mentioned.

It will be noted that the embodiment of FIG. 1 may operate without a refrigeration system. In the context of electronic circuitry, such as may be utilized in structure 12, the absence of a refrigeration system can result in a significant reduction in the size, weight, and power consumption of the structure provided to cool the circuit components of structure 12.

Although a particular embodiment of a cooling system is described with reference to FIG. 1, it will be appreciated that the system of FIG. 1 is included by way of example only, and embodiments of the disclosure are similarly applicable to a wide variety of cooling systems not described.

In certain embodiments, it may be desirable to maintain a constant boiling point for the fluid coolant regardless of heat load or heat sink. As more or less heat is produced, more or less active area within condenser heat exchanger 41 may be needed to condense resulting vapor. Similarly, as the temperature of a heat sink varies (e.g., varying ambient air temperature), more or less active area within condenser heat exchanger 41 may be needed to condense resulting vapor. Pressure within condenser heat exchanger 41 may be used as an indicator of boiling point. In certain embodiments, a boiling point may be held constant by maintaining a constant pressure within condenser heat exchanger 41. Given a controlled boiling point, a varying heat load, and no control over the heat sink, a level of coolant within a condenser heat exchanger 41 may be adjusted to control the area of exchanger 41 that can condense vaporized coolant. Accordingly, in certain embodiments, the proper condenser heat exchanger coolant level corresponds to where the active area of a condenser heat exchanger 41 removes a heat load while holding the boiling point at a desired level, represented in the following equation:

$$\dot{Q}=KA(T_{boil}-T_{air})$$

where $\dot{Q}$ represents the rate of heat removal from the vapor and/or fluid, K represents the overall heat transfer coefficient from the vapor and/or fluid to the ambient air, A represents the heat transfer area consistent with the definition of K (e.g., the inside condensing area for the vapor, or the outside cooling air contact area associated with the corresponding inside condensing area), $T_{boil}$ represents the local vapor saturation boiling temperature, and $T_{air}$ represents the ambient air temperature far away from the heat transfer source. Note that A may vary depending on the height of liquid in the heat exchanger.

Theoretically, a cooling loop as discussed above should contain only coolant. As a practical matter, however, non-condensable gases such as external air (in-leakage air) may possibly leak into the cooling loop for various reasons such as, for example, damage to the system, aging seals, or fitting leakage. Thus for a large system with potentially many more connections and fittings, a SACS will almost certainly have air leaks into the system. Non-condensable gases can originate from dissolved gases in the initial charge of liquid coolant, or in additional quantities of coolant added to the system to make up for coolant lost during normal operation. In the normal operation of the SACS, the air will tend to be concentrated in the condenser with the largest concentration just above the water level. To the extent that non-condensable gases such as air accumulate within the system, they can significantly decrease the heat removal capability and efficiency of the system. Additionally, the presence of such non-condensable gases (i.e., in-leakage air) within the system may affect the coolant level within a condensing heat exchanger.

Air concentration in a condenser may be undesirable because it lowers the condensing heat transfer coefficient and reduces the heat removal capability of a given heat exchanger or requires a lower temperature heat sink for the same boiling temperature in the evaporator. Additionally, in the case of a coolant fluid (e.g., water) with a density similar to that of in-leakage air, there may be no clear separation of coolant vapor and in-leakage air within a condensing heat exchanger.

In particular embodiments of a SACS, a level of liquid coolant in a heat exchanger may decrease as the concentration of air in the condenser increases. This effect may occur because the total pressure in the heat exchanger increases as the air concentration increases. With a lower coolant level (for example, resulting from removal of coolant from the condenser to control temperature and/or active area), the active area of the condenser for dissipating heat may increase. The air content may be monitored to, for example, allow for control of the coolant level. In various applications, changes in the heat removal requirement for a SACS may affect the desired coolant level in the condenser. In addition, the temperature of cooling air and even the velocity of cooling air may affect the desired coolant level in the condenser. In certain embodiments, the air content of the coolant vapor in the condenser may be monitored to yield desired control of the coolant level and active area in a heat exchanger. Accordingly, certain embodiments teach methods for estimating air content of coolant vapor within a SACS.

According to certain embodiments, a lookup table may be created to estimate air within a SACS, or determine when excess air accumulates within a condenser. A lookup table may be generated based on various properties of the system. Such properties may change depending on the quantity of air in the system. Data contained in such lookup tables may, in certain embodiments, be used for a design of experiments (DOE) analysis to generate an analytical expression (or surface) useful for predictions and control. As used herein, the terms "expression" and "surface" are used interchangeably. Such a DOE analysis may yield an expression describing an analytical surface using a limited number of data points.

For example, as explained below, measurements may be taken for a SACS in a controlled environment, such as in an environment where the heat load and amount of air in the system are controlled. Such measurements may include measurements of properties that can be used to estimate the amount of air in a SACS, such as a temperature, a pressure, a liquid level, a velocity, and/or a gradient of any such measurements, and such measurements may be taken or made of, in, or near any practicable components of a SACS. Data obtained in such methods may be used to generate analytical expressions.

Generated tables may be used to estimate an amount of air contained in a SACS based on the operational measurements. In this way, experimental measurements may be used to generate models useful for interpreting "real-world" measurements. The present disclosure may occasionally refer to measurements as "experimental," "operational," or otherwise, and the meaning of such phrases will be clear to one of skill in the art. Certain examples of methods are described below, according to certain embodiments.

The methods may be performed in any suitable manner. As an example, the methods may be performed by a component that includes an interface, logic, memory, and/or other suitable element. An interface receives input, sends output, processes the input and/or output, and/or performs other suitable operation. An interface may comprise hardware and/or software.

Logic performs the operations of the component, for example, executes instructions to generate output from input. Logic may include hardware, software, and/or other logic. Logic may be encoded in one or more tangible media or other memory and may perform operations when executed by a computer. Certain logic, such as a processor, may manage the operation of a component. Examples of a processor include one or more computers, one or more microprocessors, one or more applications, and/or other logic.

A memory stores information. A memory may comprise one or more tangible, computer-readable, and/or computer-executable storage medium. Examples of memory include computer memory (for example, Random Access Memory (RAM) or Read Only Memory (ROM)), mass storage media (for example, a hard disk), removable storage media (for example, a Compact Disk (CD) or a Digital Video Disk (DVD)), database and/or network storage (for example, a server), and/or other computer-readable medium.

Figure 2:
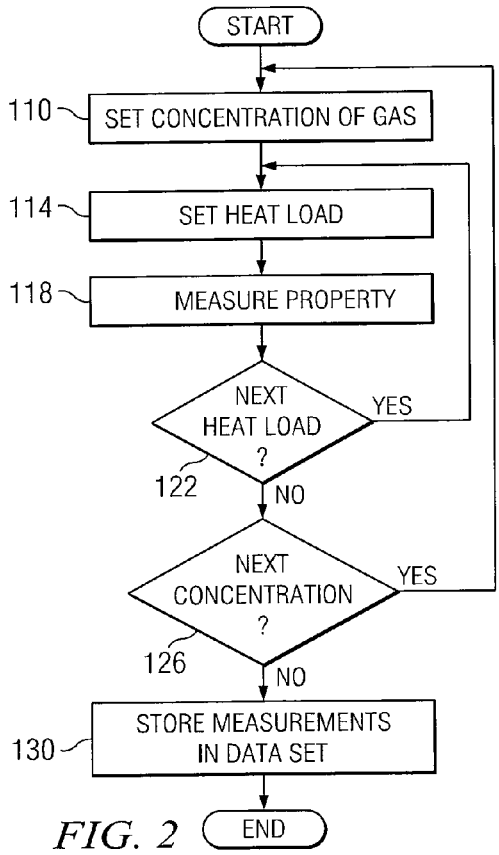
FIG. 2 is a flowchart of an example of method for estimating air in a cooling system.

FIG. 2 is a flowchart of an example of a method for estimating air in a cooling system. In certain embodiments, measurements of a property that can be used to estimate air in the cooling system are taken for different heat loads and different concentrations of non-condensable gas in the cooling system. A lookup table may be generated from the measurements.

The method begins at step 110, where the concentration of non-condensable gas in the cooling system is set. The concentration may be set by controlling the amount of gas in the system. The heat load of a condenser of the cooling system is set at step 114. A property that can be used to estimate air in the cooling system is measured at step 118. Examples of the measurements are discussed below. A next heat load may be selected at step 122. If so, the method returns to step 114 to set the next heat load. If not, the method proceeds to step 126. A concentration of non-condensable gas may be selected at step 126. If so, the method returns to step 110 to set the next concentration. If not, the method proceeds to step 130, where the measurements are stored in a data set. Details of various embodiments of performing the method are discussed below.

In particular embodiments, a set of data may be generated that begins with no air in the system, setting a measured heat load, and measuring and recording a corresponding liquid level in the condenser as liquid level data. The measurements may be repeated for various heat loads to further build the first data set. The concentration of air in the condenser may then be increased to a known value, and measurements may be repeated, varying the heat load across a spectrum, to generate a second set of data. This process may be repeated for various air concentrations with the heat load varied until sufficient data exists for a DOE analysis. Accordingly, in certain embodiments, a lookup table and DOE expression may be generated based on air concentration in the condenser and the heat load.

According to certain embodiments, additional methods may be used to generate lookup tables and/or enhanced lookup tables. For example, in certain embodiments, a lookup table and DOE expression may be based on a pressure and temperature differential between an evaporator (e.g., a heat exchanger 23 in FIG. 1) and a condenser (e.g., condenser heat exchanger 41 in FIG. 1) for a SACS. In certain embodiments of a SACS, there will be a pressure differential between an evaporator and condenser and a vapor flow and resulting pressure drop between them. For example, this relationship may be expressed mathematically as:

$$P_{v\text{-}evap} > P_{v\text{-}cond}$$

where $P_{v\text{-}evap}$ represents the vapor pressure of the fluid (coolant) leaving the evaporator, and $P_{v\text{-}cond}$ represents the vapor pressure of the fluid in the condenser.

Accordingly, the temperature in the condenser may be lower than the temperature leaving the evaporator since the coolant fluid is, by design, in a saturated condition. Utilizing this knowledge, a lookup table and/or DOE expression may be generated using pressure and temperature measurements in the evaporator and separately in the condenser, varying heat load and air levels accordingly. These measurements may also be made with no entrained air, and with other variations such as heat input and heat rejection.

Measurements may be taken inside and/or outside the condenser and/or evaporator in certain embodiments. In certain embodiments, a first measurement may be taken near an inlet of a condenser and a second measurement may be taken near an outlet of an evaporator. In some embodiments, a first measurement may be taken inside a condenser and a second measurement may be taken between the condenser and evaporator. It should be understood that measurements discussed in the disclosure may be taken at any practicable point and should not be limited based on particular examples described.

In certain embodiments, an air leak and the resulting concentration of air in a condenser of a SACS affects the levels. The presence of air in the coolant vapor within the condenser may cause additional pressure within the condenser and result in a lower water level in the condenser to maintain a desired rate of heat removal. Accordingly, in certain embodiments, the total pressure in the condenser may deviate from the saturation pressure at a particular temperature. Expressed mathematically, for example:

$$P_{total\text{-}cond} = P_{v\text{-}cond} + P_{air}$$

where $P_{total\text{-}cond}$ represents the total pressure in the condenser, and $P_{air}$ represents the additional partial pressure in the condenser caused by the accumulated air.

Thus, the pressure differential allows for measuring temperature and total pressure in the evaporator and condenser, adding data to a lookup table. As a result, in certain embodiments, a lookup table may be built by measuring the pressure and/or temperature at the condenser and exchanger, varying the heat load at known levels with no air in the system, adding a known quantity of air, again varying the heat load with an increased amount of air in the system, and systematically repeating the process for various air amounts. Such a lookup table may be based on pressure at a particular location in the condenser above the water level, and on a heat load for a given pressure and temperature in the evaporator. Additionally note that, in particular embodiments, the heat load may be directly related to vapor mass flow between the evaporator and condenser. Thus the heat load may also be directly related to the pressure drop between the evaporator and condenser.

As an additional example of a method for creating a lookup table according to certain embodiments, a lookup table and DOE expression may be based on the air/vapor concentration gradient in a condenser. During operation where there is a relatively low air-leak rate, a SACS condenser may have an air/vapor concentration gradient. For example, in certain embodiments, the largest concentration of air within a condenser may be just above the liquid coolant level. As heat removal continues from the condenser, the local vapor pressure may stay at a saturation condition. Thus, there may be a vapor pressure gradient down the condenser and a resulting temperature gradient in the condenser, the gradient corresponding to the direction of flow.

In certain embodiments, the condensation and resulting flow may tend to drive air down in the condenser, while diffusion may tend to disperse the air uniformly in the condenser. This gradient may vary as the heat load (and corresponding flow rate) vary. With this concentration gradient due to diffusion in the condenser, the resulting temperature gradient in the condenser may be measured and recorded as a function of heat load and concentration gradient to generate a lookup table. In certain embodiments, for example, consider the effect of 10% addition of air (by pressure) into coolant (e.g., water) vapor in a condenser. At a temperature of 110 F (43.33 C), steam saturation pressure is 1.2750 psia. If this pressure instead represented 90% water vapor and 10% air (with the assumption that both were ideal gases), the pressure of the water vapor would then be 1.1475 psia. This new pressure corresponds to a saturation temperature of 106.37 F (41.32 C). Accordingly, the change in temperature of 3.63 F (2.02 C) may easily be measured. Such measurements provide a foundation for creating a lookup table according to certain embodiments.

Accordingly, in certain embodiments, a lookup table may be generated by monitoring the temperature gradient in the condenser such as, for example, measuring the difference between two or more locations disposed in a condenser. Such a method may include measuring a first temperature, for example, just above a coolant level in the condenser and a second temperature near a vapor inlet in a condenser with no air in the condenser, and subsequently taking additional measurements under various heat loads. A measured volume of air may be added to the system, the heat load varied, and the resulting temperature gradients may additionally be used for the lookup table. This may be repeated as necessary with various air levels in the system. A variation of cooling air flow rate/velocity may also be included in certain embodiments for generating a lookup table. Further, additional measurement points may be added, and the location of measurement points may be altered. In certain embodiments, measurement points may be located in any practicable place on, in, around, or near a condenser. A measured amount of air may then be introduced to the condenser, resulting in a gradient due to condensation and diffusion. Additional measurements would be taken accordingly, and additional iterations conducted until sufficient data exists to generate a lookup table.

Certain embodiments of any of the methods described may include and/or incorporate additional methods to generate, for example, enhanced lookup tables. For example, a lookup table constructed according to any of the above described methods may additionally incorporate other data and/or variables obtained from controlled experimentation, such as data related to a heat sink or a particular system configuration or type, to create an enhanced lookup table. For example, a lookup table and/or enhanced lookup table may include data accounting for a particular type of heat sink (e.g., air, liquid, etc.), flow rate (e.g., an airflow rate), ambient temperature, changing heat sink conditions, and similar properties. As an additional example, a lookup table and/or enhanced lookup table may additionally include data related to the condition of a heat exchanger, such as damage, corrosion, or fouling of a heat exchanger. Further, an enhanced lookup table may include multiple measurements according to various methods such as those described above to achieve an accurate estimate of air in a system.

Although the various examples mentioned in the disclosure with reference to certain embodiments, it should be noted that the examples are provided for illustrative purposes only, and various embodiments may include additional data as may be found helpful for creating a lookup table and/or DOE analysis. Accordingly, in particular embodiments, one, none, or several of the above-described measurements and/or lookup tables may be combined. Although certain measurements may be sufficient to provide a lookup table, additional measurements may be included to provide additional accuracy in estimations. For example, an enhanced or advanced lookup table may be generated from data relating to the relation between liquid level/heat load/air content in a system and the relation between temperature gradient/heat load/air content in the system. Such embodiments may provide additional advantages, such as, for example, increased precision in measurements and/or estimation of air content within a SACS. Further, described methods for creating lookup tables and/or enhanced lookup tables may be useful to determine the amount of air in the vapor mixture within the condenser, and the desirability of removing the air from a SACS.

Numerous other changes, substitutions, variations, alterations, and modifications may be ascertained by those skilled in the art as intended that the present invention encompass all such changes, substitutions, variations, alterations, and modifications as falling within the spirit and scope of the appended claims. Moreover, the present invention is not intended to be limited in any way by any statement in the specification that is otherwise reflected in the claims.

What is claimed is:

1. A method for estimating air comprising a non-condensable gas in a cooling system, comprising:

performing the following for a plurality of concentrations of non-condensable gas in a cooling system:

in a controlled environment, setting the concentration of the non-condensable gas in the cooling system at a known value; and performing the following for a plurality of heat loads to yield a plurality of measurements:

in the controlled environment, setting the heat load of a condenser of the cooling system at a known level; and measuring a property that can be used to estimate air in the cooling system; and storing the measurements in a data set.

2. The method of claim 1, the setting the concentration of the non-condensable gas in the cooling system further comprising:

prior to measuring the property, controlling the volume of the non-condensable gas in the cooling system by setting the volume at the known value.

3. The method of claim 1, the measuring the property that can be used to estimate air in the cooling system further comprising:

measuring a liquid level of the condenser.

4. The method of claim 1, the measuring the property that can be used to estimate air in the cooling system further comprising:

measuring a temperature differential between the condenser and an evaporator of the cooling system.

5. The method of claim 1, the measuring the property that can be used to estimate air in the cooling system further comprising:

measuring a pressure differential between the condenser and an evaporator of the cooling system.

6. The method of claim 1, the measuring the property that can be used to estimate air in the cooling system further comprising:

measuring a temperature gradient of the condenser.

7. The method of claim 1, the measuring the property that can be used to estimate air in the cooling system further comprising:

measuring a pressure gradient of the condenser.

8. The method of claim 1, the measuring the property that can be used to estimate air in the cooling system further comprising:

taking a first measurement of the property at an inlet of the condenser; and taking a second measurement of the property at an outlet of an evaporator of the cooling system.

9. The method of claim 1, the measuring the property that can be used to estimate air in the cooling system further comprising:

taking a first measurement of the property inside of the condenser and taking a second measurement of the property between the condenser and an evaporator of the cooling system.

10. The method of claim 1, further comprising:

generating a lookup table from the data set.

11. A non-transitory computer readable storage medium encoded with computer code configured to:

perform the following for a plurality of concentrations of non-condensable gas in a cooling system:

in a controlled environment, set the concentration of the non-condensable gas in the cooling system at a known value; and perform the following for a plurality of heat loads to yield a plurality of measurements:

in the controlled environment, set the heat load of a condenser of the cooling system at a known level; and measure a property that can be used to estimate air comprising the non-condensable gas in the cooling system; and store the measurements in a data set.

12. The non-transitory computer readable storage medium of claim 11, the computer code further configured to set the concentration of the non-condensable gas in the cooling system by:

prior to measuring the property, controlling the volume of the non-condensable gas in the cooling system by setting the volume at the known value.

13. The non-transitory computer readable storage medium of claim 11, the computer code further configured to measure the property that can be used to estimate air in the cooling system by:

measuring a liquid level of the condenser.

14. The non-transitory computer readable storage medium of claim 11, the computer code further configured to measure the property that can be used to estimate air in the cooling system by:

measuring a temperature differential between the condenser and an evaporator of the cooling system.

15. The non-transitory computer readable storage medium of claim 11, the computer code further configured to measure the property that can be used to estimate air in the cooling system by:

measuring a pressure differential between the condenser and an evaporator of the cooling system.

16. The non-transitory computer readable storage medium of claim 11, the computer code further configured to measure the property that can be used to estimate air in the cooling system by:

measuring a temperature gradient of the condenser.

17. The non-transitory computer readable storage medium of claim 11, the computer code further configured to measure the property that can be used to estimate air in the cooling system by:

measuring a pressure gradient of the condenser.

18. The non-transitory computer readable storage medium of claim 11, the computer code further configured to measure the property that can be used to estimate air in the cooling system by:

taking a first measurement of the property at an inlet of the condenser; and taking a second measurement of the property at an outlet of an evaporator of the cooling system.

19. The non-transitory computer readable storage medium of claim 11, the computer code further configured to measure the property that can be used to estimate air in the cooling system by:

taking a first measurement of the property inside of the condenser and taking a second measurement of the property between the condenser and an evaporator of the cooling system.

20. The non-transitory computer readable storage medium of claim 11, the computer code further configured to:

generate a lookup table from the data set.

21. A system for estimating air comprising a non-condensable gas in a cooling system, comprising:

means for performing the following for a plurality of concentrations of non-condensable gas in a cooling system:

setting the concentration of the non-condensable gas in the cooling system; and performing the following for a plurality of heat loads to yield a plurality of measurements:

setting the heat load of a condenser of the cooling system; and measuring a property that can be used to estimate air in the cooling system; and means for storing the measurements in a data set.

* * * * *